US010155265B2

(12) United States Patent
Naseri

(10) Patent No.: US 10,155,265 B2
(45) Date of Patent: Dec. 18, 2018

(54) METHOD FOR POSITIONING CORE BY SOLUBLE WAX IN INVESTMENT CASTING

(71) Applicant: Mapna Group, Tehran (IR)

(72) Inventor: Mohammed Naseri, Karaj (IR)

(73) Assignee: Mapna Group Co., Tehran (IR)

( * ) Notice: Subject to any disclaimer, the term of this patent is extended or adjusted under 35 U.S.C. 154(b) by 8 days.

(21) Appl. No.: 15/391,892

(22) Filed: Dec. 28, 2016

(65) Prior Publication Data

US 2018/0178278 A1 Jun. 28, 2018

(51) Int. Cl.

| | |
|---|---|
| ***B22D 27/04*** | (2006.01) |
| ***B22C 7/02*** | (2006.01) |
| ***B22C 9/04*** | (2006.01) |
| ***B22C 9/10*** | (2006.01) |
| ***B22C 9/24*** | (2006.01) |
| ***B22D 29/00*** | (2006.01) |
| ***F01D 5/18*** | (2006.01) |
| ***F01D 9/02*** | (2006.01) |
| ***F01D 25/12*** | (2006.01) |

(52) U.S. Cl.

CPC ..... *B22D 27/04* (2013.01); *B22C 7/02* (2013.01); *B22C 9/043* (2013.01); *B22C 9/103* (2013.01); *B22C 9/108* (2013.01); *B22C 9/24* (2013.01); *B22D 29/002* (2013.01); *F01D 5/187* (2013.01); *F01D 9/02* (2013.01); *F01D 25/12* (2013.01); *F05D 2220/32* (2013.01); *F05D 2230/211* (2013.01); *F05D 2300/175* (2013.01); *F05D 2300/177* (2013.01)

(58) Field of Classification Search

CPC .... B22C 7/02; B22C 9/04; B22C 9/10; B22C 9/108; B22C 9/24; B22C 9/103; B22D 27/04; B22D 29/00; B22D 29/001; B22D 29/002

USPC ..... 164/516, 28, 35, 45, 361, 369

See application file for complete search history.

(56) References Cited

U.S. PATENT DOCUMENTS

| | | | | |
|---|---|---|---|---|
| 2006/0213632 | A1* | 9/2006 | Vogt et al. | B22C 7/02 164/6 |
| 2011/0299999 | A1* | 12/2011 | James | B22C 9/04 416/97 R |
| 2012/0285648 | A1* | 11/2012 | Mueller et al. | B22C 7/02 164/6 |
| 2013/0333855 | A1* | 12/2013 | Merrill et al. | B22C 7/02 164/45 |

* cited by examiner

*Primary Examiner* — Kevin P Kerns
(74) *Attorney, Agent, or Firm* — Jafar Shamsi

(57) ABSTRACT

A method for making internal passages for use in investment casting processes, especially for gas turbine components such as blades or vanes. The apparatus includes a first mold cavity having grooves formed therein, a second mold cavity having a shape complementary to the final casting design and ceramic cores. Each groove of the first mold cavity has a depth equal to a radius of a certain number of ceramic cores which correspond to cooling channels. The ceramic cores are placed in the first mold cavity and fugitive wax is injected for temporary positioning of the cores. Two fugitive wax segments are formed about the cores. The fugitive segments locate the ceramic cores in the second mold cavity, and wax is injected about the cores and locating segments to form a pattern for investment casting process.

10 Claims, 10 Drawing Sheets

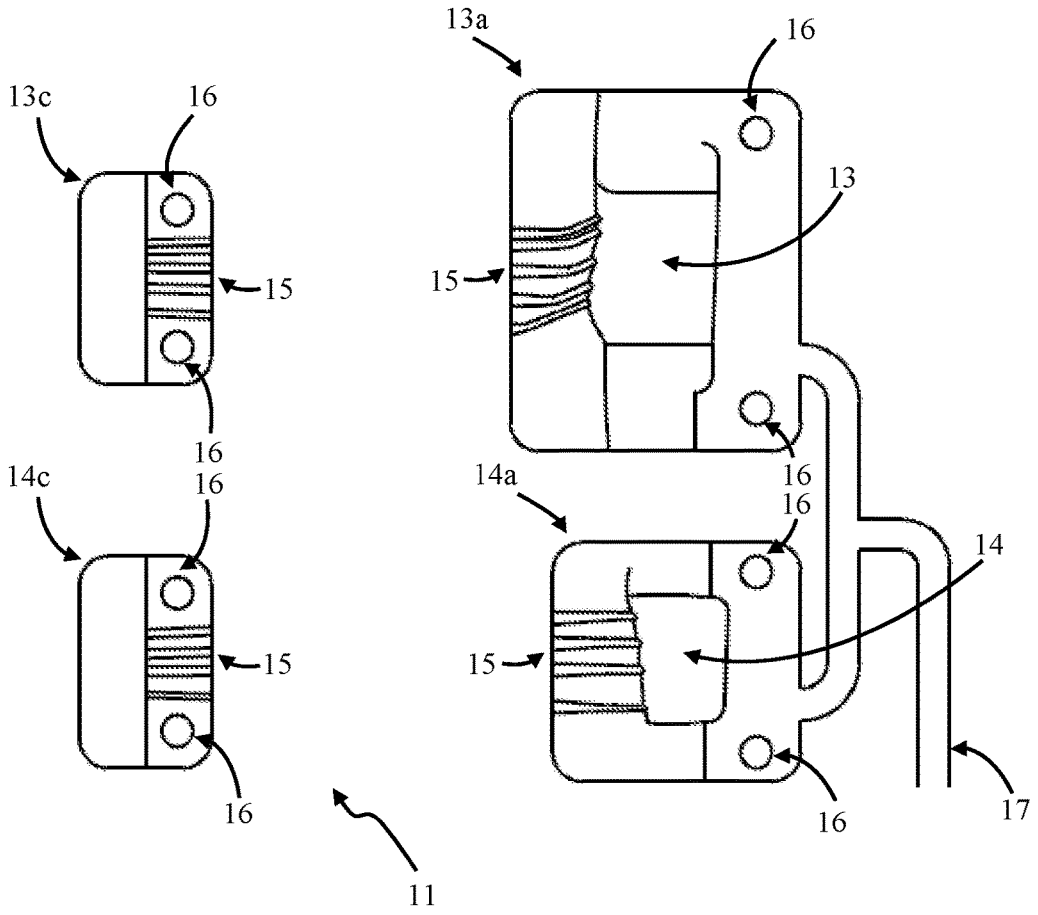
Fig. 2.A

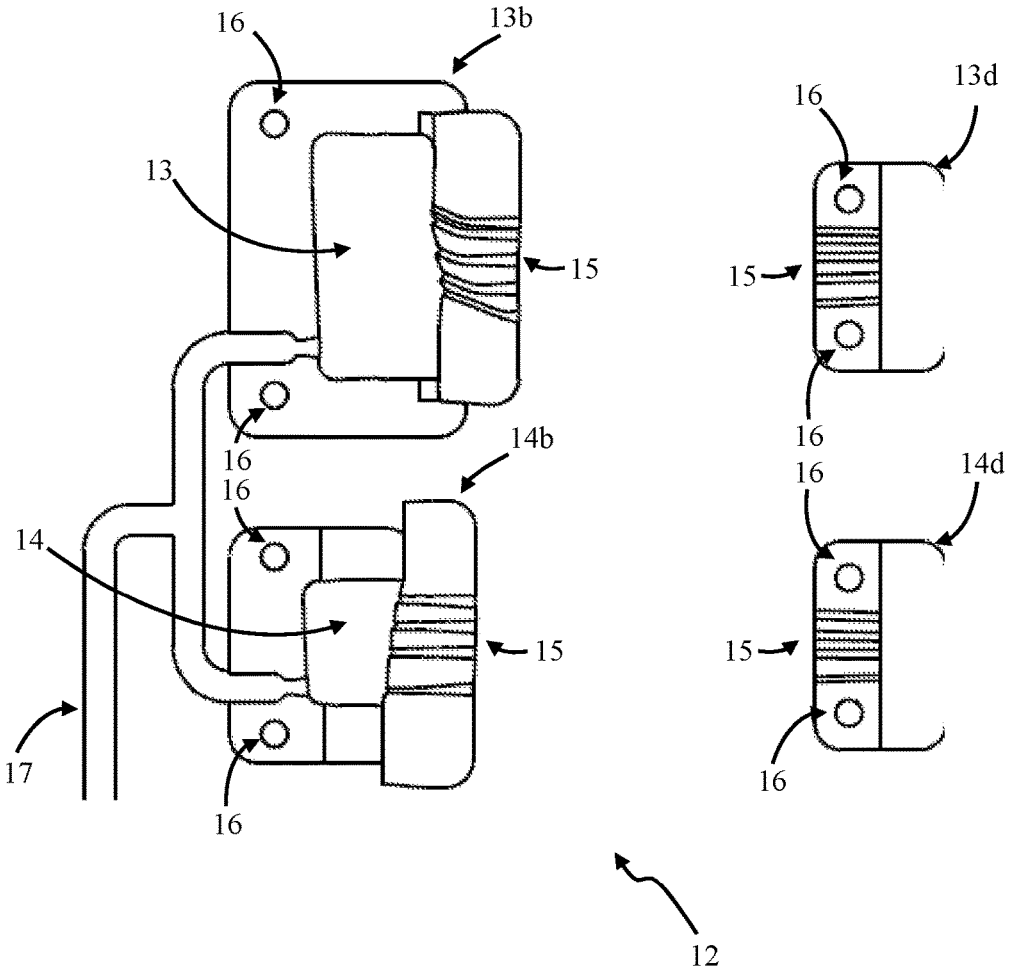
Fig. 2.B

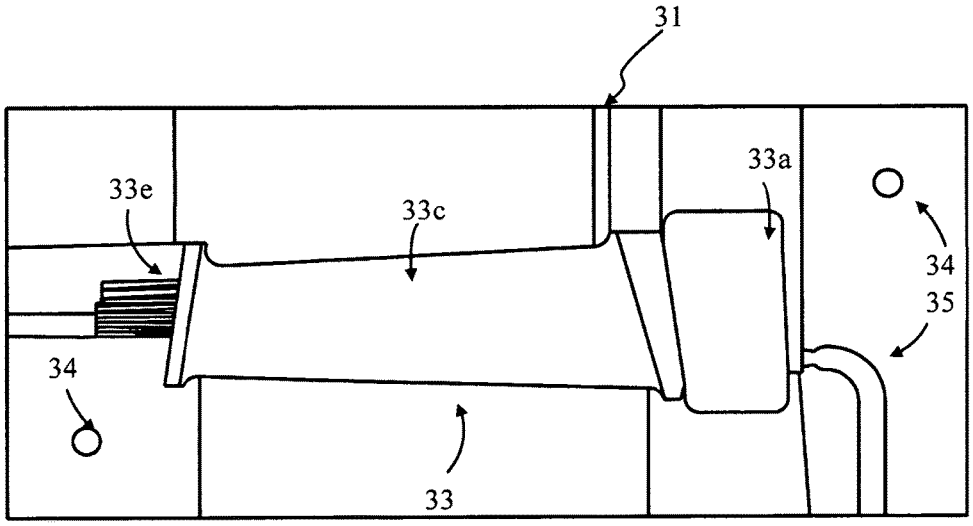
Fig. 4.A

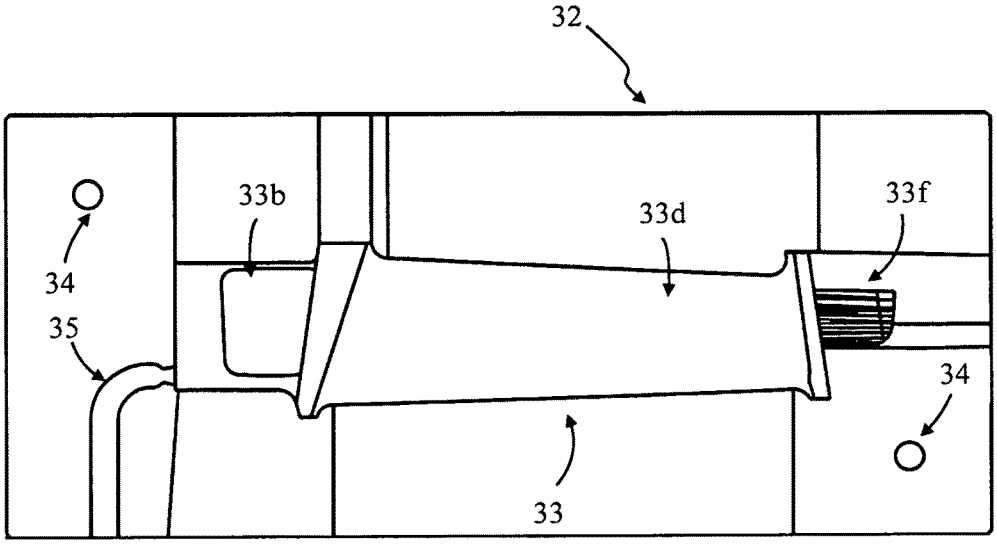
Fig. 4.B

METHOD FOR POSITIONING CORE BY SOLUBLE WAX IN INVESTMENT CASTING

TECHNICAL FIELD

The present invention relates to positioning method for multi piece ceramic cores in investment casting of turbine components to create internal cooling passages in castings.

BACKGROUND

In conventional casting of nickel or cobalt based super-alloy turbine blades, quartz cores are frequently used to produce radial cooling air holes or passages in the castings. Quartz cores are extensively used since quartz is relatively cheap, easily formable into thin cores with bends, and is easy to remove from casting by conventional chemical leaching processes. Furthermore, quartz compared with common core ceramics is considerably stronger and can be formed into more complex shapes without breaking down during the casting. Slender passages as small as 0.003 inch in diameter are now produced in castings through use of quartz tubes, which is used in combination with conventional ceramics to form the core.

Due to these benefits, quartz cores are ideally suited for the manufacture of equiaxed grain turbine blade castings having cast-in holes, where typically range of pouring temperature is from 2550 to 2800 degrees F. Generally at temperatures below 2800 degrees F., unreinforced quartz cores do not distort because of their own weight and also are not deflected by flow of molten metal into the mold.

But occasionally in small blade designs using quartz cores are difficult while injection of them in a wax die has very high risk because of failure of cores due to brittle structure of quartz. Another limitation in the casting of turbine blades with quartz tubes is that the cores are often required to be formed through bending as non linear passage due to the design of the cooling passages in the blade airfoil. Moreover, when the blade has some elements that are close together the design and positioning of cores are very difficult. The cores generally are extended from tip of blade through the root, so that which the cores are extended out from the root and diverged to more than one side, positioning of cores are very considerable because geometry of diverged cores make it difficult, to design of wax injection die.

For positioning the cores in described conditions, the conventional methods such as pins or locators cannot easily be used. Different types of pins and locators are used for solid or tubular cores that have large diameters. These methods cannot be easily applied for cores with small diameters which have bends, especially when they are close together because of several air cooling passages. Other techniques such as wax support used for positioning ceramic solid cores in hollow blades or vanes cannot be used for tubular cores because of their geometry and small diameter.

So an improved method is needed for positioning cores in investment casting process where the multiple cores have the intricate design. An objective of the present invention is to provide a method for positioned cores to meet this need.

SUMMARY

To this end, this invention provides a method for positioning cores for use in casting a melt wherein the positioned cores are embedded in two distinct fugitive wax segments.

In the present invention, an apparatus includes a first mold, a second mold, ceramic cores, and means for injecting fugitive and final wax.

The first mold has a cavity formed therein for fugitive material or another soluble material such as soluble wax. Each of grooves of cavity has a depth equal to the radius of certain tubular cores. When the ceramic cores, which create the cooling passages, are inserted into the first mold cavity and fugitive wax is injected, the features that position the cores are formed about the cores. The features with the cores are then removed from the first mold and placed in the second mold. The second mold has a cavity that is complementary in shape to the casting design of blade or vane. The features properly locate the ceramic cores within the second mold cavity to ensure that the position of cores in final blade is correct. Wax is then injected into the second mold cavity. The wax adheres to the features and surrounds the cores. The wax-covered ceramic cores and fugitive wax are then removed from the second mold.

Fugitive segments adhering the final wax are then solved in water. Wax pattern containing only tubular cores is now prepared for investment casting. A ceramic shell is formed about the wax until required thickness, and the wax is melted, leaving a cavity comprises positioned cores therein. Molten super-alloy is then cast into the cavity to form a blade. After metal is cooled, conventional leaching processes are used to remove ceramic cores from the casting to create tubular cooling channels.

BRIEF DESCRIPTION OF DRAWINGS

FIG. 2.A. is a front perspective view of the bottom half of a first mold for injection of positioning features.

FIG. 2.B. is a front perspective view of the top half of a first mold for injection of positioning features.

FIG. 4.A is a front perspective view of the bottom half of a second mold for production of a wax blade.

FIG. 4.B is a front perspective view of the top half of a second mold for production of a wax blade.

DETAILED DESCRIPTION

The present invention includes a method for positioning cores in a wax pattern to use in casting a nickel or cobalt base super-alloy gas turbine blade or vane. Employing a two-step molding process to inject wax around ceramic cores, intricate cooling channels are created during casting.

The invention can be practiced for complicated ceramic shapes with different assemblies to cast different metals and alloys.

Figure 1:
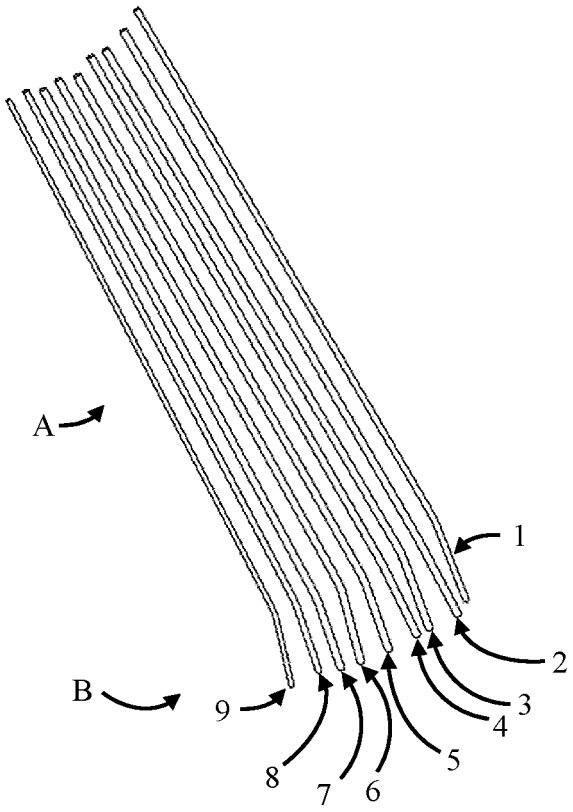
Fig. 1 (Prior Art)
FIG. 1 is schematic view of prebend quartz tubular quartz cores.

FIG. 1 shows a group of ceramic cores with different diameters. According to arrangement of cooling passages in the turbine blade, the cores were marked from 1 to 9, where number 1 is adjacent the leading edge and number 9 is adjacent the trailing edge. Each of the cores has two sections which are connected at the bend; section A is a direct form of core in root of blade and section B is a bent form of core in airfoil, as described in FIG. 1. Due to high plurality of cores for positioning, they are divided into two parts according to their location in blade, 5 cores close to convex surface comprising numbers 1, 3, 5, 7 and 8, and 4 cores close to concave surface comprising numbers 2, 4, 6 and 9.

In one embodiment of the inventions, several thin walled quartz tubular members are employed having a wall thickness between about 0.01 inch and about 0.015 inch. The thickness of core tubes affects sagging or distortion from their own weight and also rate of removal by chemical leaching. The cores have different outer and inner diameters according to design of cooling passages.

FIG. 2.A and FIG. 2.B illustrate a bottom half 11 and a top half 12 of a first mold, respectively, for forming fugitive segments that position the cores. Bottom and top halves of first molds are coupled together by a hinge (not shown). First mold has two cavities, large size 13 and small size 14, which each of them is designed for each part of cores that described earlier.

Each of these cavities comprises two parts in each of bottom and top half of first mold. A plurality of grooves 15 is formed in each of mold cavities 13 and 14 whereas the depth of each groove is equal to half of outer diameter of certain core. Indeed each core is placed in a certain groove in the own cavity.

Large cavity 13 has portions 13*a* and 13*c* in bottom half 11, FIG. 2. A, and portions 13*b* and 13*d* in top half 12, FIG. 2. B. Five prebend tubular cores with numbers 1, 3, 5, 7 and 8 are placed in locations in 13*a* and 13*c* while the bended regions of cores B are seated on the grooves 15 in the 13*a* and the straight regions of cores A are seated on the 13*c*. Then the portions of 13*b* and 13*d* are put on the 13*a* and 13*c*, respectively. Indeed when the two halves 11 and 12 of first mold are brought together in a closed position, portions 13*a* and 13*b* in one side register by pin guides 16 together to form a single, complete cavity 13 for fugitive material and portions 13*c* and 13*d* in other side unit by pin guides 16 to complete the positioning role of cavity 13 while the cores are fixed between portions 13*c* and 13*d* in region A and also portions 13*a* and 13*b* in region B.

Small cavity 14 has portions 14*a* and 14*c* in bottom half 11, FIG. 2. A, and portions 14*b* and 14*d* in top half 12, FIG. 2.B. In this cavity four prebend tubular cores with numbers 2, 4, 6 and 9 are placed in certain groove similar to order mentioned for large cavity.

Although FIG. 2 illustrates two cavities 13 and 14 are integrally designed in first mold but it is possible that the two cavities are separate, which each cavity having two halves, bottom and top.

Figure 3:
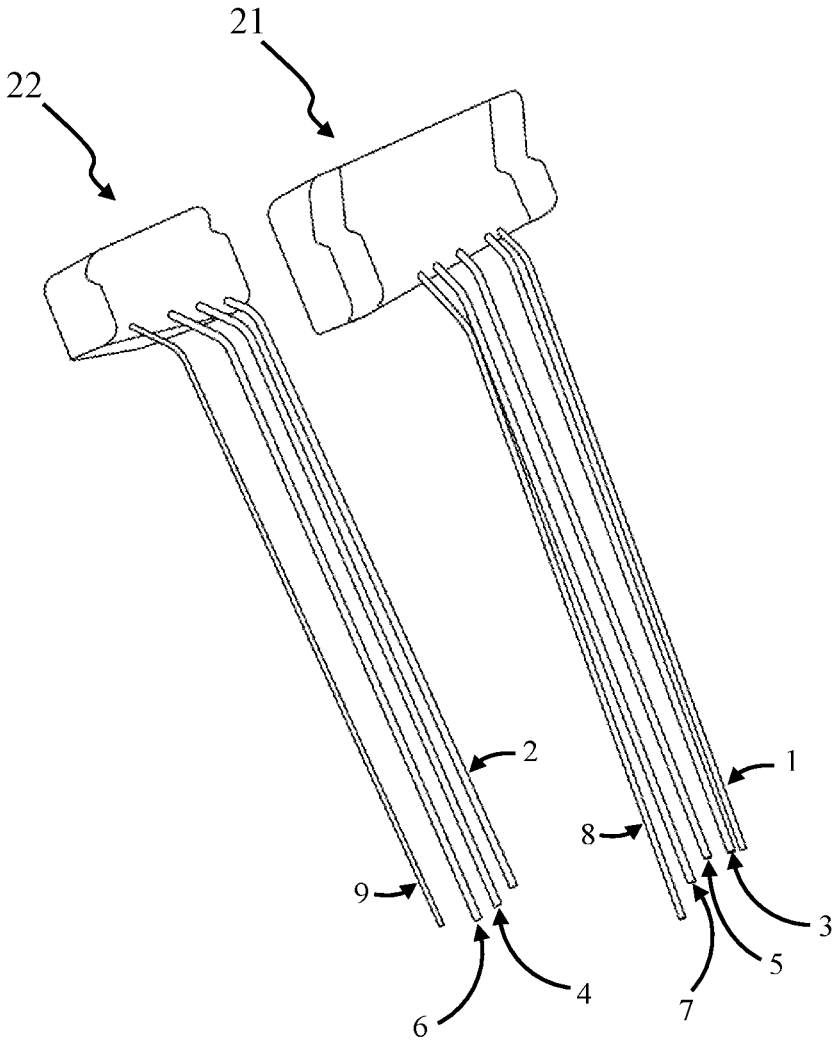
FIG. 3 is a schematic view of two features formed in first mold positioning the ceramic cores in accordance with the present invention.

The first mold includes a duct 17 for supplying injected wax to two cavities. In addition the duct divides into two branches for each cavity. Fugitive wax segments are injected into the first mold and two features are formed, as shown in FIG. 3. The tubular quartz cores are positioned by two features 21 and 22 while each of these positions certain numbers of cores as mentioned here above. Five cores (numbers 1, 3, 5, 7 and 8) are positioned by the large feature 21 formed in large cavity 13 and four cores (numbers 2, 4, 6 and 9) are positioned by the small feature 22 formed in small cavity 14.

Features and their cores are placed in bottom half 31 and top half 32 of second mold as shown in FIG. 4.A. and FIG. 4.B. Second mold has two halves 31, 32 are coupled together by a hinge (not shown). Second mold has a cavity 33 that comprising portions 33*a*, 33*c* and 33*e* in bottom half and 33*b*, 33*d* and 33*f* in top half. When the two halves 31 and 32 of second mold are brought together in a closed position, by pin guides 34, portions 33*a*, 33*b*, 33*c*, 33*d*, 33*e* and 33*f* unit complete cavity.

Second mold cavity is designed to receive small and large features 21, 22 and also the positioned cores. Large feature 21 is placed in cavity 33*a* in bottom half of second mold and small feature 22 is placed in 33*b* in top half. The end of cores of each feature are extended and fixed between portions of 33*e* and 33*f* of the second mold. In each of portions 33*e* and 33*f*, nine grooves similar to 16 in first mold, are formed. Each groove has a depth that is equal to the radius of certain core. When the mold is closed, the bottom and top half complete a close space for fixing each of cores.

After the locating features and cores in their places, the wax is injected into cavity between 33*c* and 33*d* from duct 35 of second mold. In particular expandable pattern wax, plastic or other material is introduced into the spaces between cores and about the features (21 and 22) to form a pattern that embeds the gathered cores (1-9). The parameters of the injection are very important because the quartz tubes are very brittle especially when they have bends.

So it is suggested that the high temperature and low pressure injection can protect the cores.

Although the cores can be held and protected by fugitive segments, the direction of duct 35 for injection in the second mold should be parallel to cores for preventing breakage and even displacement of cores. Also for decreasing the mechanical pressure to the cores, the friction between cores and semi liquid wax should be decreased by using higher amount of releasing agent spray on the cores before injection.

Figure 5:
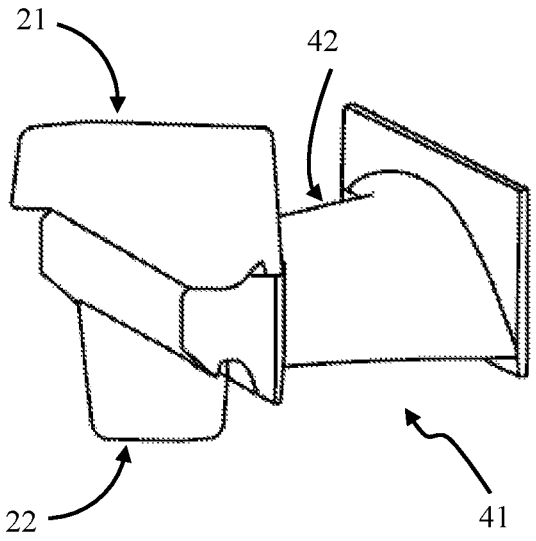
FIG. 5 is a schematic view of an injected wax close to the features and cores.

After the molten wax has solidified, the complex 41 comprising wax pattern 42, features 21, 22 and their cores 1-9 are removed from the second mold as shown in FIG. 5.

Figure 6:
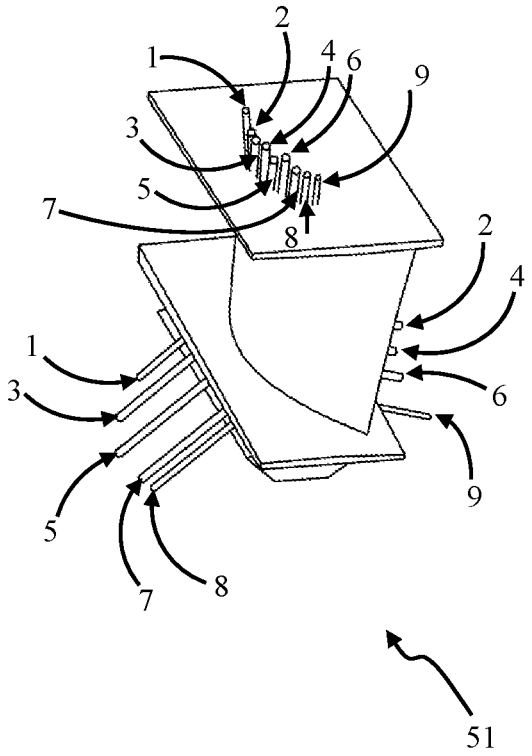
FIG. 6 is a schematic view of a wax blade comprising positioned cores therein without fugitive wax.

For removing fugitive features, the complex 41 dipped in water at 20-30° C. for 10 hours. For accelerating solution of fugitive material, it is be possible using diluted nitric acid especially when the shape of fugitive material is complicated. However, nitric acid may be better than water due to better and faster removal. FIG. 6 illustrates the wax covered cores 51 without fugitive features.

Figure 7:
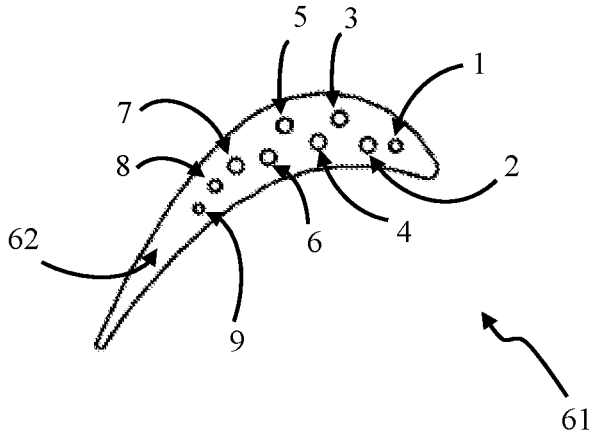
FIG. 7 is a schematic sectional view through the airfoil the blade of FIG. 6.

Following the solution of fugitive material, the ends of bent and straight forms of the quartz cores extract from root and tip of blade, respectively. FIG. 7 illustrates section 61 through the middle of airfoil of wax blade 51 which the wax 62 surrounds the cores (1-9) correctly.

Because the thermal expansion of the core and shell are usually different, it is necessary to provide axial slip to allow small movement and thermal expansion of the quartz core relative to shell during the firing of shell and also casting process. For achieving this target a little wax is added to the straight end of cores that plays an important role for assuring the integrity of the cores. This avoids cracking or distortion from different thermal expansion coefficients of quartz and the ceramic shell material which comprises silica, zircon, alumina or other conventional shell materials and ceramic binder.

But for locking the location of cores it is better that region B of core is fully fixed without any freedom in shell because the high amount slip of this end may cause large lateral movement.

The final pattern with slipping core strategies then is invested in ceramic shell pursuant to the well known lost wax by repeated dipping in ceramic slurry, draining excess slurry and stuccoing with coarse grain ceramic stucco until a shell mold is built up on the pattern tree to a desired thickness.

After the end of coating, ceramic shells are dewaxed in an autoclave under conditions of suitable temperature and pressure.

The shell then is fired at elevated temperatures to acquire sufficient strength for casting. Molten superalloy then is poured into the shell that has cavity of blade and cores that positioned into the shell.

The molten superalloy can be solidified in the shell about the cores. The shell is removed from the solidified casting using a mechanical knock-out operation. The cores are selectively removed from the solidified casting by chemical leaching or other conventional core removal methods.

The spaces previously occupied by the core elements 1-9 comprise complex cooling air passages in the casted blade, while the superalloy in the spaces forms internal walls of the separating the cooling passages.

Figure 8:
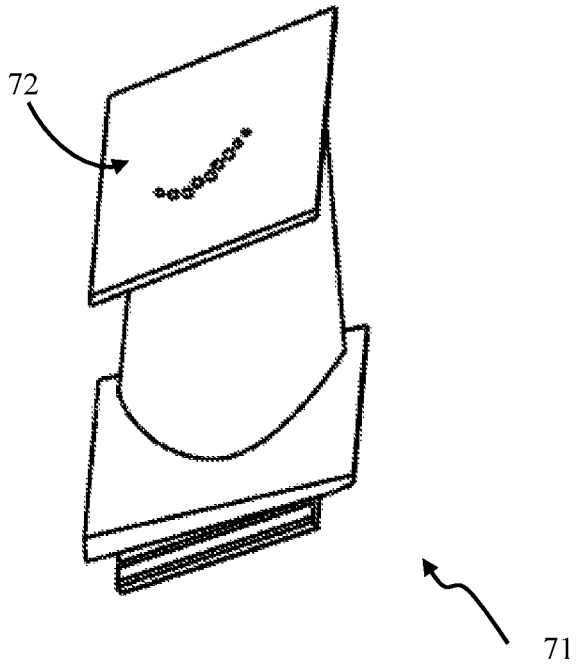
FIG. 8 is a schematic view of the blade casting with internal cooling channels extending to tip of the blade.

FIG. 8 illustrates a hollow blade casting 71 manufactured in accordance with the present invention with a plurality of channels 72 formed therein.

The present invention makes possible the casting of such components as blades and vanes for gas turbine engine in superalloy materials using investment shell molding to produce equiaxed grained components and having accurately defined, radially extending air cooling passages which may extend through one or more end of the blades or vane.

The present invention also makes possible the casting of such components as blades or vanes having cooling passages containing bends which, as described earlier in the specification were believed to be impossible or very difficult without positioning features in small castings.

The core assemblies including several elements is formed in novel manner by two fugitive segments when the cores are extended two ends of one side of blade or vane which the embedding of several thin walled quartz tubular cores alone in patterns especially in small casting design is very complicated and may be impossible.

These core assemblies (features) are quite complex, time consuming and costly as a result of use of the multiple cores in soluble wax. In addition, these features of the procedure can result in dimensional accuracy and repeatedly of the core assemblies and thus airfoil castings produced using such core assemblies.

While the invention has been described here above in terms of specific modifications thereof, it is not intended to be limited and changes can made therein without departing from the scope of the invention as set forth in following claims.

What is claimed is:

1. Method of making an airfoil casting with internal air cooling passages to form several individual bended channels, comprising the following steps:

Placing ceramic cores into a first mold cavity, the first mold cavity having two features, each one having several grooves formed therein for each core element;

Injecting fugitive material into the first mold cavity to make two fugitive material segments about the ceramic cores, the fugitive material segments positioning the ceramic cores, Placing the ceramic cores with the fugitive material segments into a second mold cavity, the second mold cavity having a shape complementary to a desired final blade design, the fugitive material segments correctly positioning the ceramic cores in the second mold cavity, Injecting wax into the second mold cavity, the wax covering the fugitive material and several of the ceramic cores, dissolution of fugitive material segments, forming a final pattern for shell making in investment casting, Melting the wax to leave a gap between a shell and the positioned ceramic cores therein; and casting molten metal into the gap to form the airfoil casting.

2. The method of claim 1 wherein said ceramic cores comprise a plurality of 9 tubular cores.

3. The method of claim 2 wherein said tubular cores are made of quartz or silica rich material that are required to be easily leached.

4. The method of claim 3 wherein said tubular quartz cores include bends.

5. The method of claim 4 wherein said tubular cores have a wall thickness between about 0.01 and 0.015 inches.

6. The method according to claim 1, further comprising providing the first mold cavity with several grooves, each groove having a depth equal to a radius of cores corresponding to coolings of airfoil casting channels.

7. The method of claim 1 wherein said fugitive material is made of a water soluble wax or other soluble material.

8. The method according to claim 1, wherein placing the ceramic cores into the first and second mold cavities includes fully locating the ceramic cores within both of the first and second mold cavities.

9. The method of claim 1 wherein said melt is solidified by polycrystalline solidification to produce an equiaxed grain casting.

10. The method according to claim 1, further comprising removal of the ceramic cores from the airfoil casting via leaching processes.

* * * * *